US005634988A

United States Patent [19]

Kurebayashi et al.

[11] Patent Number: 5,634,988

[45] Date of Patent: Jun. 3, 1997

[54] HIGH TENSILE STEEL HAVING EXCELLENT FATIGUE STRENGTH AT ITS WELD AND WELDABILITY AND PROCESS FOR PRODUCING THE SAME

[75] Inventors: Katsumi Kurebayashi; Shuji Aihara; Atsushi Seto, all of Futtsu, Japan

[73] Assignee: Nippon Steel Corporation, Tokyo, Japan

[21] Appl. No.: 411,738

[22] PCT Filed: Aug. 4, 1994

[86] PCT No.: PCT/JP94/01297

§ 371 Date: Apr. 4, 1995

§ 102(e) Date: Apr. 4, 1995

[87] PCT Pub. No.: WO95/04838

PCT Pub. Date: Feb. 16, 1995

[30] Foreign Application Priority Data

Mar. 25, 1993 [JP] Japan ..... 5-66718
Aug. 4, 1993 [JP] Japan ..... 5-193350

[51] Int. Cl.[6] ..... C21D 8/04; B32B 15/18; C22C 38/02

[52] U.S. Cl. ..... 148/320; 428/682; 148/654

[58] Field of Search ..... 420/128; 148/320, 148/654; 428/683, 682

[56] References Cited

U.S. PATENT DOCUMENTS 4,279,647 7/1981 Giflo .
4,299,621 11/1981 Giflo .
5,312,493 5/1994 Masui et al. ..... 148/654

FOREIGN PATENT DOCUMENTS 48-11221 2/1973 Japan ..... 148/320
56-81620 7/1981 Japan ..... 148/320
59-110490 6/1984 Japan .
61-217529 9/1986 Japan ..... 148/320
62-10239 1/1987 Japan .
3-301823 12/1989 Japan .
3-56301 8/1991 Japan .
3-264645 11/1991 Japan .
406240356 8/1994 Japan ..... 148/654

*Primary Examiner*—Deborah Yee
*Attorney, Agent, or Firm*—Kenyon & Kenyon

[57] ABSTRACT

The present invention relates to a high tensile welded steel plate consisting essentially of, by weight, C: 0.03 to 0.20%, Si: 0.6 to 2.0%, Mn: 0.6 to 2.0%, Al: 0.01 to 0.08%, B: not more than 0.0020%, and N: 0.002 to 0.008% and optionally at least one element selected from Cu, Mo, Ni, Cr, Nb, V, Ti, Ca, and REM with the balance consisting of Fe and unavoidable impurities, and a process for producing a high tensile welded steel plate, usually comprising the steps of: subjecting a slab comprising the above chemical compositions to hot rolling or alternatively hot rolling followed by controlled rolling. The present invention enables fatigue cracking of the as-welded steel, in its heat-affected zone, to be prevented and, at the same time, the propagation of the crack to be prevented or inhibited.

15 Claims, 1 Drawing Sheet

HIGH TENSILE STEEL HAVING EXCELLENT FATIGUE STRENGTH AT ITS WELD AND WELDABILITY AND PROCESS FOR PRODUCING THE SAME

TECHNICAL FIELD

The present invention relates to a high tensile welded steel plate, having excellent fatigue strength at its weld and weldability, for shipbuilding, offshore structures, bridges, and the like and a process for producing the same.

BACKGROUND ART

Recently, with an increase in size of structures, a reduction in weight of structural members has become important. In order to realize this, an effort has been made to increase the tensile strength of a steel plate used in the structures. Since, however, ships, offshore structures, bridges, and the like repeatedly undergo loading during use, consideration should be given to the prevention of fatigue failure. Welds are sites where a fatigue fracture is most likely to occur, which has led to a demand for an improvement in fatigue strength at the weld.

Up to now, the factors governing the fatigue strength at the weld and an improvement in the fatigue strength have been studied, and an improvement in fatigue strength at the weld has been primarily attempted by mechanical factors, such as a reduction in stress concentration through an improvement in the shape of the toe of the weld such as shaping of the toe of weld by grinding using a grinder or heat-remelting of the final layer of the weld bead, or shot peening treatment or other treatments for creating compressive stress at the toe of weld (Japanese Unexamined Patent Publication (Kokai) Nos. 59-110490 and 1-301823 and the like). Further, it is well known that the effect of reducing the residual stress can be attained by post-weld heat treatment.

On the other hand, a proposal has been made wherein the fatigue strength at a weld is improved by taking advantage of chemical compositions of steel products without use of the above special execution and post-weld heat treatment.

In Japanese Unexamined Patent Publication (Kokai) No. 62-10239, in order to prevent a deterioration in fatigue properties at a spot weld even in the case of high C and high Mn levels by increasing the Si content and specifying the amounts of C and P added, a high-strength thin steel sheet having excellent fatigue properties in spot welding, comprising C: not more than 0.3%, Si: 0.7 to 1.1%, Mn: not more than 2.0%, P: not more than 0.16%, and sol. Al: 0.02 to 0.1%, is disclosed.

In Japanese Unexamined Patent Publication (Kokai) No. 3-264645, in order to attain good stretch-flange ability, fatigue properties, and resistance weldability by advantageously forming clean polygonal ferrite by Si, strengthening and improving the hardenability of a steel by B, a high-strength thin steel sheet having excellent stretch-flange ability and other properties, comprising C: 0.01 to 0.2%, Mn: 0.6 to 2.5%, Si: 0.02 to 1.5%, B: 0.0005 to 0.1%, and the like, is disclosed.

In Japanese Examined Patent Publication (Kokoku) No. 3-56301, in order to advantageously improve the fatigue strength of a joint at its spot weld by optimizing the chemical compositions in the steel and the proportion of unrecrystallized structure in the steel sheet by adding B or the like, a very low carbon steel plate having a good spot weldability, comprising C: not more than 0.006%, Mn: not more than 0.5%, Al: not more than 0.05%, and 0.001 to 0.100% in total of at least one member selected from Ti and/or Nb in a solid solution form exclusive of a nitride and a sulfide, is disclosed.

Among the above techniques, the techniques disclosed in Japanese Unexamined Patent Publication (Kokai) Nos. 59-110490 and 1-301823 requires special execution after welding and cannot improve the fatigue strength of the as-welded steel. The technique where heat treatment is carried out after welding requires additional steps and unfavorably complicates welding procedure. Further, the effect attained by the technique is limited.

The thin steel sheets disclosed in Japanese Unexamined Patent Publication (Kokai) Nos. 62-10239 and 3-264645 are those of which the applications are mainly limited to base materials of wheels and disks for automobiles, and these steel sheets are quite different from steel plates used in shipbuilding and offshore structures, contemplated in the present invention, in applications, plate thickness, and use. Therefore, the findings associated with these steel sheets, as such, cannot be applied to the steel plates. Also regarding steel chemical compositions, the thin steel sheet disclosed in Japanese Unexamined Patent Publication (Kokai) No. 62-10239 specifies particularly the relationship between the C and P contents to C: less than 0.22%, P: not more than 0.16%, and C: 0.22 to 0.3% with $C+0.6P \leqq 0.31$ from the viewpoint of improving the fatigue strength at its spot weld, and this publication is utterly silent on solid-solution strengthening of a ferritic structure at a weld formed by arc welding.

Specifically, spot welding is a kind of resistance welding and used mainly in welding of thin steel sheets having a sheet thickness in the range of from about 0.5 to 3.5 mm after forming, for example, welding of thin steel sheets for members of automobiles. In the spot welding, portions to be welded are clamped between electrodes, and a large current is passed through the assembly for a short time.

Therefore, the spot welding is different from arc welding used in welding of high-tensile steel plates, having a thickness of not less than 6 mm, as materials for shipbuilding, offshore structures, bridges, and the like in welding process, such as shape of electrodes, use or not of welding materials, and welding conditions, as well as in the shape of the weld, the weld residual stress, and the like, resulting in a difference in factors governing the fatigue strength between both the welding methods. Thus, even though the fatigue strength could be improved in spot welding, the findings for spot welding, as such, cannot be applied to arc welding.

On the other hand, for the thin steel sheet disclosed in Japanese Unexamined Patent Publication (Kokai) No. 3-264645, B is added to improve the strength and hardenability of the steel, thereby providing a desired structure. This publication is silent on the relationship between the addition of B and the weldability. Further, no mention is made of an improvement in fatigue strength of welds besides base materials.

Japanese Examined Patent Publication (Kokoku) No. 3-56301 describes a spot weld of a very low carbon steel sheet and aims to regulate the hardness distribution at a spot weld. In this steel sheet, B is added to refine the structure and prevent grain growth. The upper limit of the amount of B added is set from the viewpoint of preventing a deterioration in material, and no study is made of the weldability.

An object of the present invention is to improve the fatigue strength of a weld of structural members, particularly a weld formed by arc welding.

Another object of the present invention is to improve the fatigue strength of structural members at their welds, particularly a weld heat affected zone (hereinafter referred to as "HAZ") of structural members by regulating the HAZ micro-structure of the as-welded structural members.

A further object of the present invention is to provide a high-tensile steel plate having weldability good enough to stop weld cracking upon welding.

A further object of the present invention is to provide a process for producing a high-tensile steel plate which can attain the above object.

DISCLOSURE OF INVENTION

In order to attain the above object, the present invention provides the following high-tensile welded steel plate.

The fundamental concept of the present invention will now be described.

(1) The present inventors have microscopically observed the occurrence and propagation of cracks in a fatigue specimen of a weld joint. As a result, they have found that the fatigue cracking, in many cases, occurs in a boundary between the weld metal and the HAZ where repeated stress concentrates, propagates through the HAZ and further propagates to the base materials, resulting in the failure of the specimen.

The results of the observation suggest that the HAZ micro-structure, at which fatigue cracking occurs and through which the fatigue cracking propagates, is greatly related to the fatigue strength. The fatigue occurs due to repeated motion of dislocation. These facts have led to a conclusion that, in order to improve the fatigue strength at a weld, the HAZ micro-structure should be strengthened so as to suppress the occurrence and propagation of fatigue cracking, thereby inhibiting dislocation motion.

Micro-structural strengthening methods generally include solid-solution strengthening, precipitation strengthening, and dislocation strengthening. Since the weld is rapidly heated and cooled, precipitates are also dissolved, making it impossible to strengthen the as-welded HAZ micro-structure by precipitation strengthening. Further, even though the base material could be strengthened by deformation dislocation, the dislocation density is reduced by welding, rendering the dislocation strengthening unsuitable for strengthening. In this sense, the solid-solution strengthening is effective for strengthening the HAZ micro-structure.

Elements useful for solid-solution strengthening are, in the order of effectiveness, C, N, P, Si, Cu, and Mo. For C and N, which are interstitial elements, the solid-solution strengthening effect is large. However, the influence of these elements on various properties other than solid-solution strengthening, such as hardenability, weldability, and toughness, is larger than the solid-solution strengthening effect, and mere increase in the amount of these elements added cannot lead to exclusive solid-solution strengthening of the HAZ micro-structure. P too exhibits a large solid-solution strengthening effect. Since, however, it renders grain boundaries brittle, the P content should be reduced. On the other hand, for Si, Cu, and Mo, which are substitutional elements, although the proportion of the solid-solution strengthening to the amount thereof added is lower than that for C, N, and P, these elements can be added in a larger amount than the insterstitial elements, rendering these substitutional elements useful for solid-solution strengthening. Si serves to reduce stacking fault energy and cross slip, thereby preventing the localization of the deformation at the time of repeated plastic deformation and, at the same time, enhancing the reversibility of plastic deformation to prevent cracking.

Therefore, the addition of Si is considered effective for improving the fatigue strength.

Based on the above results of studies, T-shaped fillet weld joints as shown in FIG. 1 were prepared from various high-tensile steels plates, which have undergone solid-solution strengthening using Si. These joints were subjected to a fatigue test, which has led to the finding described above in connection with the present invention.

(2) In the preparation of T-shaped fillet weld joints, a high-tensile steel containing a large amount of B gave rise to cold cracking in HAZ. Cold cracking in a high-tensile steel at its weld is unacceptable, and, in this case, it is, of course, expected that the application of repeated load easily gives rise to fatigue failure starting at the cold crack. The carbon equivalent Pcm, which is a measure of susceptibility to cold cracking, is expressed by the following equation.

$$Pcm=C+Si/30+Mn/20+Cu/20+Ni/60+Cr/20+Mo/15+V/10+5B \quad (1)$$

As can be understood from the above equation, B among the above elements has the highest susceptibility to cold cracking (the larger the coefficient, the higher the susceptibility to cracking).

Since, however, B serves to inhibit the formation of grain boundary ferrite causative of fatigue cracking, the amount of B added should be not more than 0.0020%, in which the inhibitory effect is saturated, when the susceptibility to cold cracking is taken into consideration. Further, when the Pcm value is high due to a combination of elements, the amount of B added is preferably limited to less than 0.0005% which has substantially no effect on the susceptibility to cold cracking.

For this reason, a premise for improving the fatigue strength of the weld is that B is limited so as to ensure the weldability.

In order to ensure weldability good enough to inhibit cold cracking, elements other than B, as described above, should be also taken into consideration in the regulation of the carbon equivalent Pcm. For example, if steel plates having a thickness of 15 mm, as described in working examples of the present application, are welded, the welding can be successfully made at room temperature by bringing the Pcm value to not more than 0.26. When the Pcm value is larger than 0.26, it is necessary to additionally provide the step of inhibiting penetration of hydrogen, the step of preheating the steel sheet plate, and other steps.

(3) The described invention relies on the following microscopic observation on the occurrence and propagation of cracking of a fatigue specimen for a weld joint and, as a result, the present inventors have found the relationship between the HAZ micro-structure and the fatigue strength. The HAZ micro-structure is classified according to the hardenability of the steel into ferritic micro-structure, bainite micro-structure, and martensitic micro-structure, and the HAZ micro-structure of commercially available high-tensile steels is, in many cases, a bainite micro-structure. In this case, the bainite micro-structure includes both an upper bainite structure and a lower bainite micro-structure, and the proportion of the bainite structure to the whole micro-structure as observed under a microscope is defined as the bainite micro-structure fraction.

When the hardenability of the HAZ micro-structure is low, the ferritic micro-structure fraction is higher than 20% and the bainite micro-structure fraction is lower than 80%, the fatigue cracking is likely to start from grain boundary ferrite or a soft ferritic micro-structure, such as ferrite side plate, so that the fatigue strength is not improved. On the other hand, when the hardenability is high, the martensitic micro-structure fraction is higher than 20% and the bainite micro-structure fraction is lower than 80%, the fatigue cracking starts at the grain boundary in the interface of a hard martensitic micro-structure. In this case as well, no improvement in fatigue strength can be attained.

Based on the above finding, it was confirmed that an improvement in fatigue strength is derived from the bainite micro-structure, and when the fraction of the bainite micro-structure is not less than 80%, the effect of improving the fatigue strength becomes significant.

In order to bring the HAZ micro-structure to a micro-structure composed mainly of bainite, it is also useful to add suitable amounts of Ni, Cr, and v as elements for improving the hardenability of the micro-structure.

The present invention, by virtue of the above effects (1) and (2), provides a high-tensile steel plate having improved fatigue strength and weldability, and further provides a high-tensile steel plate having a higher fatigue strength by a combination of the effects (1) and (2) with the effect of the HAZ micro-structure.

The addition of Cu and Mo is advantageous for further strengthening the ferritic micro-structure in HAZ by solid solution strengthening and, at the same time, improving the hardenability. Furthermore, in the present invention, the addition of Nb is useful for inhibiting the recrystallization of ferrite in a temperature region which does not recrystallize during rolling and, at the same time, improving the hardenability, and the addition of Ti is useful for inhibiting the coarsening of the grain diameter of austenite.

Furthermore, the addition of Ca and REM is useful for fixing sulfides causative of fatigue cracking and improving the ductility.

Specifically, the present invention provides a high-tensile steel, characterized by comprising, by weight, C: 0.03 to 0.20%, Si: 0.6 to 2.0%, Mn: 0.6 to 2.0%, Al: 0.01 to 0.08%, N: 0.002 to 0.008%, and B: not more than 0.0020% with the balance consisting of Fe and unavoidable impurities. Further, the present invention provides a high-tensile steel comprising the above chemical compositions and further comprising at least one optional element selected from Cu: 0.1 to 1.5%, Mo: 0.05 to 0.5%, Ni: 0.1 to 3.0%, Cr: 0.1 to 1.0%, V: 0.01 to 0.10%, Nb: 0.005 to 0.06%, Ti: 0.005 to 0.05%, Ca: 0.0005 to 0.0050%, and REM: 0.0005 to 0.0050%. Furthermore, the present invention provides a high-tensile steel, having excellent fatigue strength at its weld and weldability, comprising the above elements, the bainite micro-structure fraction of HAZ being not less than 80%.

BEST MODE FOR CARRYING OUT THE INVENTION

Figure 1A:
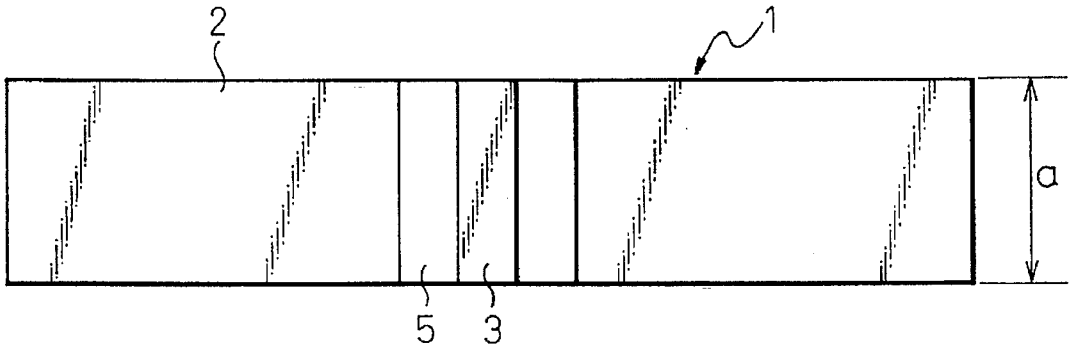
FIG. 1A is a plan view of a fatigue specimen of a T-shaped fillet weld joint.

The best mode for carrying out the present invention will now be described in detail.

At the outset, the reasons for the limitation of chemical compositions of a steel as a base material in the present invention will be described.

C is an element which serves to increase the strength of the base material, and the addition thereof in a large amount is preferred from the viewpoint of increasing the strength of the base material. The addition of C in an amount exceeding 0.20%, however, lowers the toughness of the base material and the weld, resulting in deteriorated weldability. For this reason, the upper limit of the C content is 0.20%. On the other hand, when the C content is excessively low, it becomes difficult to ensure the strength of the base material and, at the same time, the hardenability of the weld is deteriorated, leading to the formation of grain boundary pro-eutectoid ferrite harmful to the fatigue strength. Thus, when the C content is less than 0.03%, no micro-structure favorable for an improvement in fatigue strength can be formed. For this reason, the lower limit of the C content is 0.03%.

Si is a solid-solution strengthening element which does not significantly increase the hardenability. Si strengthens the micro-structure by solid-solution strengthening, inhibits dislocation motion, and inhibits fatigue cracking. Further, Si is known to reduce the stacking fault energy of the steel plate micro-structure and reduce the cross slip. Therefore, when plastic deformation is repeatedly applied to a steel plate, Si inhibits the crossing and localization of dislocation slip lines and enhances the reversibility of the plastic deformation to inhibit cracking. For this reason, Si is indispensable for improving the fatigue strength.

When the Si content is less than 0.6%, the effect of solid-solution strengthening and stacking fault energy reduction is so small that an improvement in fatigue strength cannot be expected. For this reason, the lower limit of the Si content is 0.6%. On the other hand, when Si is added in an amount exceeding 2.0%, the surface appearance is deteriorated due to the occurrence of red scale, increasing the fatigue cracking source and, at the same time, deteriorating the toughness. For this reason, the upper limit of the Si content is 2.0%.

Mn is an element which serves to increase the strength of the base material without a significant loss of toughness. When the Mn content is less than 0.6%, sufficient base material strength cannot be obtained. Therefore, the lower limit of the Mn content is 0.6%. On the other hand, when Mn is added in an amount exceeding 2.0%, the toughness of the weld is lowered and, at the same time, the weldability and the ductility are deteriorated. For this reason, the upper limit of the Mn content is limited to 2.0%.

Al is necessary as a deoxidizing element, and when the amount of Al added is less than 0.01%, the deoxidizing effect cannot be expected. On the other hand, when Al is added in an amount exceeding 0.08%, large amounts of oxides and nitrides of Al are formed, deteriorating the toughness of the weld. For this reason, the upper limit of the Al content is 0.08%.

N, when Ti is added, combines with Ti to inhibit the growth of austenite grains in HAZ. When N is less than 0.002%, this effect cannot be expected. For this reason, the lower limit of the N content is 0.002%. On the other hand, the addition of N in an excessive amount increases the amount of N in a solid solution form and lowers the HAZ toughness, so that the upper limit of the N content is 0.008%.

B serves to improve the hardenability of the HAZ micro-structure and, at the same time, to inhibit the formation of grain boundary ferrite as a fatigue crack origin. However, if significantly deteriorates the susceptibility to weld cracking to lower the weldability, and the addition thereof gives rise to weld cracking, such as root cracking and toe cracking. The effect is saturated when the B content is 0.0020%. For this reason, the upper limit of the amount of B added is 0.0020%. When the amount of alloying elements other than B is large and the Pcm is high, the upper limit of the B content is 0.0005% from the viewpoint of having substantially no effect on the susceptibility to cold cracking.

P and S are impurity elements. The lower the contents of these elements, the better the results. The upper limits of P and S each are preferably 0.020% when the toughness of the base material and the weld is taken into consideration in the case of P and when the toughness of the base material and the weld and, at the same time, a lowering in ductility in the through-thickness direction, are taken into consideration in the case of S.

Cu and Mo serve to improve the hardenability of the base material and HAZ. These elements are rather useful for reinforcing a ferrite matrix through solid-solution strengthening as with Si. The lowering of stacking fault energy by Cu and Mo is smaller than that by Si, and the effect of Cu and Mo is not significant when the amounts of Cu and MO added are less than 0.1% and less than 0.05%, respectively. For this reason, the lower limits of the Cu and Mo contents are 0.1% and 0.05%, respectively. On the other hand, when the amount of Cu and Mo added exceeds 1.5% and 0.5%, respectively, the hardenability is so high that martensite is formed to unfavorably lower the fatigue strength. For this reason, the upper limits of the Cu and Mo contents are 1.5% and 0.5%, respectively.

Ni, Cr, and V are elements which serve to improve the hardenability of the base material and HAZ. The lower limits of the Ni, Cr, and V contents are respectively 0.1%, 0.1%, and 0.01% from the viewpoint of attaining the effects of these elements. The addition of these elements in excessive amounts facilitates the formation of lower bainite and martensitic micro-structure and rather lowers the fatigue strength of the weld. For this reason, the upper limits of the Ni, Cr, and V contents are 3.0%, 1.0%, and 0.10%, respectively.

Nb has the effect of increasing the strength of the base material and, at the same time, improving the hardenability. Further, when controlled rolling and controlled cooling are applied in the production of a steel plate, the addition of Nb in an amount of not less than 0.005% is preferred for the purpose of increasing the temperature region which does not recrystallize to inhibit the recrystallization during rolling, thereby enabling controlled rolling to be carried out in a wide temperature region. The incorporation of Nb in a large amount, however, deteriorates the toughness of HAZ. For this reason, the upper limit of the Nb content is 0.06%.

Ti combines with N to form TiN which refines the HAZ micro-structure to improve the toughness of HAZ. In this respect, the addition of Ti in an amount of not less than 0.005% is necessary. The addition of Ti in an amount exceeding 0.05% saturates the effect. For this reason, the lower limit and the upper limit of the Ti content are 0.005% and 0.05%, respectively.

Ca serves to fix sulfides as a fatigue crack source to improve the ductility. Further, it can prevent the occurrence of fatigue failure starting at the sulfides. When the amount of Ca added is not more than 0.0005%, this contemplated effect cannot be expected. On the other hand, when the Ca content exceeds 0.0050%, the toughness is lowered. For this reason, the lower limit and the upper limit of the Ca content are 0.0005% and 0.0050%, respectively.

REM, as with Ca, serves to fix sulfides as a fatigue crack source to improve the ductility. Further, it can prevent the occurrence of fatigue failure starting at the sulfides. REM's are rare earth elements which have the same effect. Among REM's, La, Ce, and Y are representative examples. In order to attain the contemplated effect by the addition of REM, it is necessary to add REM in a total amount of not less than 0.0005%. The addition of REM in a total amount exceeding 0.0050%, however, saturates the effect and, at the same time, is not cost-effective. For this reason, the lower limit and the upper limit of the total amount of REM added are 0.0005% and 0.0050%, respectively.

The processes for producing a high-tensile steel plate according to the present invention will now be described.

Plates contemplated in the present invention are mainly high-tensile steels having a tensile strength of not less than 490 MPa, and steel plates having various strengths may be produced by applying the following production processes.

In any production process, a steel ingot should be austenitized to 100% prior to hot rolling. For austenitization, the steel ingot may be heated to the $Ac_3$ point or above. However, heating of the steel ingot to a temperature above 1250° C. coarsens austenite grains to increase the grain diameter after rolling, deteriorating properties of the base material, such as strength and toughness. For this reason, the heating temperature is limited to between the $Ar_3$ point and 1250° C. In order to provide good base material properties, it is necessary to reduce the grain diameter of austenite. Heating of the steel ingot makes the grain diameter of austenite very large. Therefore, after heating, hot rolling is carried out in a recrystallization temperature region where the austenite grain diameter can be reduced (ordinary rolling: rolling at a temperature of about 900° to 1250° C. with a reduction ratio of 10 to 95%).

According to a production process using the above ordinary rolling, a high-tensile steel can be stably provided at a low cost. In this case, the hot rolling is terminated in a recrystallization temperature region and then spontaneously cooled. However, lack of strength often occurs when the plate thickness is large or the amount of the added elements is small.

On the other hand, a production process using controlled rolling (rolling in an unrecrystallization temperature region at a temperature of about 750° to 900° C. for a high-tensile steel) can provide a high-tensile steel having high strength and toughness. In this case, introduction of a deformation band within austenite grains by rolling to increase the number of ferrite nuclei followed by spontaneous cooling is useful. The introduction of the deformation band requires hot rolling in an unrecrystallization temperature region with a cumulative reduction ratio of not less than 40%. However, when the cumulative reduction ratio exceeds 90%, the toughness of the base material is unfavorably lowered. For this reason, the cumulative reduction ratio is limited to 40 to 90%.

According to a production process using a combination of controlled rolling with accelerated cooling, a high-tensile steel can be provided which has higher strength than the steel prepared by the production process using controlled rolling alone. In this case, it is useful to conduct accelerated cooling, while keeping the C concentration of ferrite high, to a temperature at which the transformation is completed. In order to keep the C concentration of ferrite, cooling should be carried out at a rate of not less than 1° C./sec. However, when the cooling rate exceeds 60° C./sec, the increase in strength is saturated and the toughness is unfavorably lowered. For this reason, the cooling rate is limited to 1° to 60° C./sec. Although the temperature at which the transformation is completed is 600° C. or below, the cooling termination temperature is limited to 600° C. to room temperature because a liquid at room temperature or above is usually employed as the cooling medium.

According to a production process comprising controlled rolling, accelerated cooling, and temper heat treatment, a high-tensile steel can be provided which has higher strength and toughness than the steel prepared by the production process using a combination of controlled rolling with accelerated cooling. In this case, it is useful to recover the deformed micro-structure by decreasing the lattice defect density through the annihilation of dislocations and coalescence. When the tempering temperature is below 300° C., these effects cannot be expected. On the other hand, when it exceeds $Ac_1$ point, the transformation begins rather than the recovery. For this reason, the tempering temperature and time are limited to between 300° C. and the $Ac_1$ point and from 10 to 120 min, respectively.

EXAMPLES

Examples of the present invention will now be described.

In order to examine the influence of the amount of elements added, 16 steels of the present invention and 8 comparative steels, 24 steels in total, were melted, and 50 kg slabs having a size of 90×200×380 mm were cast in a laboratory. Chemical compositions and carbon equivalent of the steels under test are given in Table 1. The carbon equivalent was calculated by the above equation.

Production conditions for individual steels (heating temperature, accumulative reduction ratio in recrystallization region, accumulative reduction ratio in unrecrystallization region, finishing temperature, cooling initiation temperature, cooling rate, cooling termination temperature, and tempering temperature) are given in Table 2.

The accumulative reduction ratio in recrystallization region is a reduction ratio defined by (h0–h1)/h0, and the accumulative reduction ratio in the unrecrystallization region is a reduction ratio defined by (h1–h2)/h1. In the above definitions, h0 represents slab thickness (mm), h1 represents plate thickness (mm) after rolling in recrystallization temperature region or plate thickness (mm) before rolling in unrecrystallization temperature region, and h2 represents plate thickness (mm) after rolling in the unrecrystallization temperature region.

The slabs were subjected to a series of steps wherein the slab was heated to between the $Ac_3$ point and 1250° C., held at that temperature for 60 min, hot-rolled in a recrystallization temperature region, and then air cooled, or alternatively subsequently hot-rolled, without air cooling, in an uncrystallization temperature region with a cumulative reduction ratio of 40 to 90% and then air cooled, or alternatively forcibly cooled, without air cooling, at a cooling rate of 1 to 60° C./sec to a temperature in the range of from 600° C. to room temperature and then air cooled, or further heated to between the 300° C. and the $Ac_1$ point to carry out tempering thereby preparing steel plates having a final thickness of 15 mm.

The mechanical properties of the hot-rolled plates were measured. The yield stress, tensile strength, elongation at break, and Charpy impact values obtained are also given in Table 2.

Figure 1B:
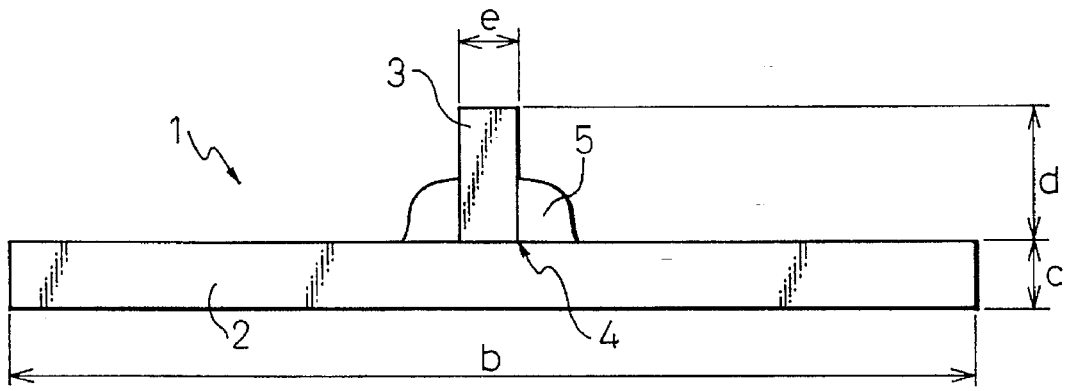
FIG. 1B is a side view of the fatigue specimen shown in FIG. 1A.

These steel plates were used to prepare a T-shaped fillet weld fatigue specimen 1 as shown in FIG. 1. In the drawing, numeral 2 designates a flat plate, and numeral 3 designates a rib plate. A fillet 4 is formed by both the plates. The fillet was welded. Numeral 5 designates a weld metal. The specimen 1 had the dimensions a=50 mm, b=200 mm, c=15 mm, d=30 mm, and e=15 mm.

Welding was carried out by shielded metal arc welding, and the weld heat input was 18 kJ/cm. The specimen 1 was subjected to a three-point bending fatigue test at a stress ratio R (minimum stress/maximum stress)=0.1. The results are given in Table 3. In this table, stress values, when the number of cycles reached $1\times10^{+5}$ times and $2\times10^{+6}$ times, are given. The bainite micro-structure fractions in HAZ micro-structures and the crack termination temperatures in an oblique Y-groove weld cracking tests (JIS Z3158) for individual steels are given in Table 4.

TABLE 1

| | | C | Si | Mn | P | S | Cu | Ni | Cr | Mo | Nb | V | Ti | Al | N | B | Ca | REM | Pcm |
|---|---|---|---|---|---|---|---|---|---|---|---|---|---|---|---|---|---|---|---|
| Steel of inv. | 1 | 0.15 | 0.68 | 1.57 | 0.005 | 0.004 | — | — | — | — | — | — | — | 0.03 | 0.002 | — | — | — | 0.251 |
| | 2 | 0.13 | 1.31 | 1.48 | 0.003 | 0.004 | — | — | — | — | — | — | — | 0.05 | 0.006 | — | — | — | 0.258 |
| | 3 | 0.12 | 1.89 | 1.24 | 0.004 | 0.005 | — | — | — | — | — | — | — | 0.04 | 0.003 | — | — | — | 0.255 |
| | 4 | 0.07 | 0.85 | 1.23 | 0.003 | 0.005 | 1.3 | — | — | — | — | — | — | 0.04 | 0.006 | — | — | — | 0.235 |
| | 5 | 0.10 | 0.91 | 1.01 | 0.005 | 0.003 | — | 1.5 | — | — | — | — | — | 0.03 | 0.003 | — | — | — | 0.216 |
| | 6 | 0.09 | 0.73 | 1.24 | 0.003 | 0.005 | — | — | 0.8 | — | — | — | — | 0.04 | 0.004 | — | — | — | 0.226 |
| | 7 | 0.08 | 1.42 | 0.94 | 0.004 | 0.006 | — | — | — | 0.4 | — | — | — | 0.03 | 0.002 | — | — | — | 0.201 |
| | 8 | 0.18 | 0.62 | 1.04 | 0.003 | 0.003 | — | — | — | — | 0.05 | — | — | 0.03 | 0.005 | — | — | — | 0.253 |
| | 9 | 0.04 | 1.94 | 1.54 | 0.005 | 0.004 | — | — | — | — | — | 0.09 | — | 0.05 | 0.002 | — | — | — | 0.191 |
| | 10 | 0.06 | 0.73 | 1.96 | 0.004 | 0.004 | — | — | — | — | — | — | 0.04 | 0.03 | 0.004 | — | — | — | 0.182 |
| | 11 | 0.09 | 1.28 | 1.12 | 0.007 | 0.002 | — | — | — | — | — | — | — | 0.02 | 0.006 | 0.0010 | — | — | 0.194 |
| | 12 | 0.10 | 1.41 | 1.01 | 0.002 | 0.008 | — | — | — | — | — | — | — | 0.06 | 0.003 | — | 0.0043 | — | 0.198 |
| | 13 | 0.10 | 0.86 | 1.23 | 0.006 | 0.007 | — | — | — | — | — | — | — | 0.07 | 0.007 | — | — | 0.0048 | 0.190 |
| | 14 | 0.12 | 0.83 | 0.86 | 0.005 | 0.005 | — | 0.5 | 0.4 | — | — | 0.04 | — | 0.04 | 0.007 | — | — | — | 0.223 |
| | 15 | 0.10 | 0.74 | 0.82 | 0.003 | 0.005 | 0.7 | — | — | 0.2 | — | — | — | 0.05 | 0.004 | — | — | — | 0.214 |
| | 16 | 0.08 | 0.87 | 0.99 | 0.003 | 0.004 | 0.2 | 0.2 | 0.2 | 0.07 | 0.01 | 0.02 | 0.01 | 0.04 | 0.004 | 0.0001 | 0.0006 | 0.0007 | 0.189 |
| Comp. steel | 1 | 0.16 | 0.21 | 1.22 | 0.004 | 0.004 | — | — | — | — | — | — | — | 0.04 | 0.006 | — | — | — | 0.228 |
| | 2 | 0.08 | 1.33 | 0.80 | 0.006 | 0.004 | 2.0 | — | — | — | — | — | — | 0.04 | 0.004 | — | — | — | 0.264 |
| | 3 | 0.06 | 0.65 | 0.76 | 0.006 | 0.004 | — | 3.5 | — | — | — | — | — | 0.04 | 0.003 | — | — | — | 0.198 |
| | 4 | 0.09 | 0.81 | 1.05 | 0.004 | 0.003 | — | — | 1.4 | — | — | — | — | 0.03 | 0.002 | — | — | — | 0.240 |
| | 5 | 0.09 | 0.72 | 0.95 | 0.005 | 0.006 | — | — | — | 0.8 | — | — | — | 0.04 | 0.004 | — | — | — | 0.215 |
| | 6 | 0.14 | 0.91 | 1.08 | 0.006 | 0.004 | — | — | — | — | 0.08 | — | — | 0.04 | 0.003 | — | — | — | 0.224 |
| | 7 | 0.06 | 1.15 | 1.67 | 0.005 | 0.004 | — | — | — | — | — | 0.15 | — | 0.03 | 0.004 | — | — | — | 0.197 |
| | 8 | 0.12 | 1.08 | 1.16 | 0.005 | 0.005 | — | — | 0.6 | 0.3 | — | — | — | 0.04 | 0.005 | 0.0032 | — | — | 0.280 |

TABLE 2

| Steel | | Production conditions: Heating temp. (°C.) | Cumulative reduction ratio in recrystallized region (%) | Cumulative reduction ratio in unrecrystallized region (%) | Finishing temp. (°C.) | Cooling initiation temp. (°C.) | Cooling rate (°C./sec) | Cooling termination temp. (°C.) | Tempering temp. (°C.) | Mechanical properties: Yield stress (MPa) | Tensile strength (MPa) | Elongation at break (%) | Charpy transition temp. (°C.) |
|---|---|---|---|---|---|---|---|---|---|---|---|---|---|
| Steel of inv. | 1 | 950 | 83 | 0 | 954 | — | Air cooling | — | — | 432 | 508 | 31.2 | −92 |
| | 2 | 1100 | 83 | 0 | 1001 | — | Air cooling | — | — | 448 | 535 | 31.7 | −73 |
| | 3 | 1100 | 72 | 40 | 858 | — | Air cooling | — | — | 496 | 583 | 29.1 | −47 |
| | 4 | 1200 | 67 | 50 | 826 | 808 | 40 | 50 | 550 | 490 | 573 | 29.2 | −96 |
| | 5 | 1230 | 72 | 40 | 857 | 841 | 10 | 500 | — | 516 | 588 | 28.2 | −98 |
| | 6 | 1200 | 58 | 60 | 849 | 817 | 20 | 580 | — | 504 | 594 | 27.3 | −92 |
| | 7 | 1160 | 72 | 40 | 851 | 829 | 40 | 100 | 600 | 473 | 569 | 29.6 | −61 |
| | 8 | 1200 | 50 | 67 | 800 | 783 | 35 | 150 | 450 | 496 | 584 | 28.3 | −95 |
| | 9 | 1240 | 67 | 50 | 810 | 785 | 10 | 450 | — | 517 | 605 | 24.2 | −45 |
| | 10 | 1150 | 72 | 40 | 823 | — | Air cooling | — | — | 441 | 519 | 31.9 | −97 |
| | 11 | 1200 | 72 | 40 | 810 | — | Air cooling | — | — | 439 | 533 | 28.2 | −73 |
| | 12 | 1190 | 50 | 67 | 841 | — | Air cooling | — | — | 471 | 535 | 28.1 | −85 |
| | 13 | 1210 | 72 | 40 | 866 | — | Air cooling | — | — | 445 | 524 | 31.7 | −71 |
| | 14 | 1150 | 72 | 40 | 837 | 807 | 20 | 550 | — | 521 | 592 | 25.5 | −86 |
| | 15 | 1100 | 50 | 67 | 851 | 824 | 15 | 70 | 500 | 479 | 563 | 28.5 | −84 |
| | 16 | 1100 | 83 | 0 | 843 | 829 | 30 | 500 | — | 487 | 573 | 30.6 | −83 |
| Comp. steel | 1 | 960 | 83 | 0 | 891 | — | Air cooling | — | — | 421 | 498 | 33.6 | −98 |
| | 2 | 1230 | 72 | 40 | 841 | — | Air cooling | — | — | 487 | 582 | 27.9 | −61 |
| | 3 | 1200 | 67 | 50 | 844 | 826 | 40 | 120 | 550 | 470 | 553 | 23.7 | −93 |
| | 4 | 1150 | 72 | 40 | 850 | 839 | 30 | 550 | — | 545 | 605 | 23.4 | −86 |
| | 5 | 1130 | 50 | 67 | 868 | 841 | 20 | 500 | — | 505 | 587 | 24.1 | −94 |
| | 6 | 1200 | 67 | 50 | 827 | 805 | 30 | 440 | — | 533 | 592 | 27.7 | −85 |
| | 7 | 1200 | 58 | 60 | 816 | 797 | 50 | 50 | 500 | 469 | 562 | 29.3 | −65 |
| | 8 | 1220 | 83 | 0 | 1050 | — | Air cooling | — | — | 421 | 505 | 29.1 | −78 |

TABLE 3

| Steel | | Results of fatigue test (MPa): Fatigue strength ($1 \times 10^5$ times) | Fatigue strength ($2 \times 10^6$ times) |
|---|---|---|---|
| Steel of inv. | 1 | 354 | 224 |
| | 2 | 368 | 231 |
| | 3 | 371 | 238 |
| | 4 | 395 | 266 |
| | 5 | 396 | 265 |
| | 6 | 388 | 258 |
| | 7 | 388 | 258 |
| | 8 | 375 | 247 |
| | 9 | 372 | 249 |
| | 10 | 381 | 251 |
| | 11 | 385 | 257 |
| | 12 | 383 | 252 |
| | 13 | 387 | 259 |
| | 14 | 396 | 265 |
| | 15 | 388 | 251 |
| | 16 | 394 | 268 |
| Comp. steel | 1 | 271 | 167 |
| | 2 | 321 | 194 |
| | 3 | 291 | 178 |
| | 4 | 303 | 189 |
| | 5 | 286 | 173 |

TABLE 3-continued

| Steel | | Results of fatigue test (MPa): Fatigue strength ($1 \times 10^5$ times) | Fatigue strength ($2 \times 10^6$ times) |
|---|---|---|---|
| | 6 | 308 | 184 |
| | 7 | 323 | 191 |
| | 8 | 327 | 199 |

TABLE 4

| Steel | | Fraction of bainite structure (%) | Crack stopping temp. (°C.) |
|---|---|---|---|
| Steel of inv. | 1 | 76 | 25 |
| | 2 | 69 | 25 |
| | 3 | 54 | 25 |
| | 4 | 83 | 25 |
| | 5 | 86 | 25 |
| | 6 | 91 | 25 |
| | 7 | 96 | 25 |
| | 8 | 89 | 25 |
| | 9 | 82 | 25 |
| | 10 | 65 | 25 |

TABLE 4-continued

| Steel | | Fraction of bainite structure (%) | Crack stopping temp. (°C.) |
|---|---|---|---|
| | 11 | 96 | 25 |
| | 12 | 72 | 25 |
| | 13 | 73 | 25 |
| | 14 | 97 | 25 |
| | 15 | 96 | 25 |
| | 16 | 87 | 25 |
| Comp. steel | 1 | 28 | 25 |
| | 2 | 15 | 50 |
| | 3 | 73 | 25 |
| | 4 | 46 | 25 |
| | 5 | 34 | 25 |
| | 6 | 48 | 25 |
| | 7 | 67 | 25 |
| | 8 | 5 | 75 |

For the steels 1, 2, and 3 of the present invention, the level of the amount of Si added are three. As compared with the steels 1 and 2 of the present invention prepared by ordinary rolling, the steel 3 of the present invention prepared by controlled rolling with a cumulative reduction ratio of 40% in an unrecrystallization region has higher yield stress and tensile strength. Further, it was found that, although an increase in the amount of Si added gives rise to an increase in fatigue strength, it also increases the Charpy transition temperature, indicating that an optimal amount of Si added exists for putting the steel to practical use.

The steels 4 to 16 of the present invention with at least one member selected from Cu, Mo, Ni, Cr, Nb, V, Ti, B, Ca, and REM being added thereto also had higher fatigue strength than the steels 1 to 3 of the present invention by virtue of synergistic effect of the effect of Si, solid-solution strengthening by Cu and Mo, the effect of improving the hardenability by Ni, Cr, and V, the inhibition of recrystallization by Nb, the inhibition of coarsening of grains by Ti and N, the effect of inhibiting grain boundary ferrite by B, on the inhibition of sulfides by Ca and REM. In these experiments, production processes used were ordinary rolling, controlled rolling, controlled rolling+accelerated cooling, controlled rolling+accelerated cooling+temper heat treatment. As compared with the use of ordinary rolling alone, a combination of ordinary rolling with controlled rolling provided a high-tensile steel having higher strength on the same carbon equivalent basis. Further, it is apparent that the fatigue strength of weld joints does not depend upon the yield stress of the base material and the tensile strength and the above effects including solid-solution strengthening by Si described above in connection with the present invention are indispensable for improving the fatigue strength.

On the other hand, the comparative steel 1 is a steel wherein the amount of Si added is smaller than the Si content range of the steel of the present invention. The fatigue strength is improved when the amount of Si added falls within the Si content range of the steel of the present invention.

For the comparative steels 2 to 8 with Cu, Mo, Ni, Cr, Nb, V, or B being added in an excessive amount, since the amount of Si added falls within a proper range, the fatigue strength is higher than that of the comparative steel 1. However, as can be understood also from the bainite microstructure fraction given in Table 4, the comparative steels 2 to 8 have excessively high hardenability and form a martensitic micro-structure to lower the bainite micro-structure fraction, so that the fatigue strength is lower than that of the steels of the present invention.

The addition of B in an excessive amount increased the crack stopping temperature in an oblique y-groove weld cracking test and remarkably deteriorated the weldability. By contrast, for all the steels of the present invention, the crack stopping temperature was low, indicating that the steels of the present invention have good weldability.

INDUSTRIAL APPLICABILITY

According to the steel of the present invention, regarding high-tensile steel plates used in ships, offshore structures, bridges, and the like, the fatigue strength, while ensuring the weldability of steel plates, can be improved by adding particular elements to regulate the micro-structure of heat affected zone, and the use of the steel plate of the present invention can improve the reliability of welded structures with respect to fatigue failure.

We claim:

1. A high tensile welded steel plate having excellent fatigue strength at its weld, and good weldability, consisting essentially of, by weight, C: 0.03 to 0.20%, Si: 0.6 to 2.0%, Mn: 0.6 to 2.0%, Al: 0.01 to 0.08%, N: 0.002 to 0.008%, and B: not more than 0.0020% with the balance consisting of Fe and unavoidable impurities, wherein said weld in its heat-affected zone has a bainite microstructure fraction of not less than 80 vol. %.

2. The welded steel plate according to claim 1, which further consists essentially of at least one element selected from the group consisting of, by weight, Cu: 0.1 to 1.5% and Mo: 0.05 to 0.5%.

3. The welded steel plate according to claim 1, which further consists essentially of at least one element selected from the group consisting of, by weight, Ni: 0.1 to 3.0%, Cr: 0.1 to 1.0%, V: 0.01 to 0.10%, and Nb: 0.005 to 0.06%.

4. The welded steel plate according to claim 1, which further consists essentially of at least one element selected from the group consisting of, by weight, Ti: 0.005 to 0.05%, Ca: 0.0005 to 0.0050%, and REM: 0.0005 to 0.0050%.

5. The welded steel plate according to claim 1, which further consists essentially of, by weight, B: less than 0.0005%.

6. A process for producing a high tensile steel plate having excellent fatigue strength at its weld when welded, and good weldability, comprising the steps of: heating a slab consisting essentially of, by weight, C: 0.03 to 0.20%, Si: 0.6 to 2.0%, Mn: 0.6 to 2.0%, Al: 0.01 to 0.08%, N: 0.002 to 0.008%, and B: not more than 0.0020% with the balance consisting of Fe and unavoidable impurities to a temperature in the range from the $Ac_3$ point to 1250° C., hot-rolling the heated slab in a recrystallization temperature region to provide a hot-rolled plate, subsequently hot rolling said plate in an unrecrystallization temperature region with a cumulative reduction ratio of 40 to 90%, and then air cooling the plate.

7. The process for producing a steel plate according to claim 6, wherein following said hot rolling in a recrystallization temperature region, and following subsequently hot-rolling said plate in an unrecrystallization temperature region with a cumulative reduction ratio of 40 to 90%, then cooling at a rate of 1° to 60° C./sec, stopping the cooling when the temperature reaches between 600° C. and room temperature, and then air cooling the plate.

8. The process for producing a high tensile steel plate according to claim 6, wherein following the hot rolling in a recrystallization temperature region, and following subsequently hot-rolling said plate in an unrecrystallization temperature region with a cumulative reduction ratio of 40 to 90%, then cooling at a rate of 1° to 60° C./sec, stopping the cooling when the temperature reaches between 600° C. and room temperature, then air cooling the plate, and then heating the plate to between 300° C. and the $Ac_1$ point for tempering the plate.

9. The process for producing a high tensile steel plate according to claim 6, wherein said steel further consists essentially of at least one element selected from the group consisting of, by weight, Cu: 0.1 to 1.5%, Mo: 0.05 to 0.5%, Ni: 0.1 to 3.0%, Cr: 0.1 to 1.0%, V: 0.01 to 0.10%, Nb: 0.005 to 0.06%, Ti: 0.005 to 0.05%, Ca: 0.0005 to 0.0050%, and REM: 0.0005 to 0.0050%.

10. The high tensile welded steel plate according to claim 2, which further consists essentially of at least one element selected from the group consisting of, by weight, Ni: 0.1 to 3.0%, Cr: 0.1 to 1.0%, V: 0.01 to 0.10%, Nb: 0.005 to 0.06%.

11. The high tensile welded steel plate according to claim 2, which further consists essentially of at least one element selected from the group consisting of, by weight, Ti: 0.005 to 0.05%, Ca: 0.0005 to 0.0050%, and REM: 0.0005 to 0.0050%.

12. The high tensile welded steel plate according to claim 3, which further consists essentially of at least one element selected from the group consisting of, by weight, Ti: 0.005 to 0.05%, Ca: 0.0005 to 0.0050%, and REM: 0.0005 to 0.0050%.

13. The high tensile welded steel plate according to claim 10, which further consists essentially of at least one element selected from the group consisting of, by weight, Ti: 0.005 to 0.05%, Ca: 0.0005 to 0.0050%, and REM: 0.0005 to 0.0050%.

14. The process for producing a high tensile steel plate according to claim 7, wherein said steel further consists essentially of at least one element selected from the group consisting of, by weight, Cu: 0.1 to 1.5%, Mo: 0.05 to 0.5%, Ni: 0.1 to 3.0%, Cr: 0.1 to 1.0%, V: 0.01 to 0.10%, Nb: 0.005 to 0.06%, Ti: 0.005 to 0.05%, Ca: 0.0005 to 0.0050%, and REM: 0.0005 to 0.0050%.

15. The process for producing a high tensile steel plate according to claim 8, wherein said steel further consists essentially of at least one element selected from the group consisting of, by weight, Cu: 0.1 to 1.5%, Mo: 0.05 to 0.5%, Ni: 0.1 to 3.0%, Cr: 0.1 to 1.0%, V: 0.01 to 0.10%, Nb: 0.005 to 0.06%, Ti: 0.005 to 0.05%, Ca: 0.0005 to 0.0050%, and REM: 0.0005 to 0.0050%.

* * * * *

UNITED STATES PATENT AND TRADEMARK OFFICE

CERTIFICATE OF CORRECTION

PATENT NO. : 5,634,988

DATED : June 3, 1997

INVENTOR(S) : Katsumi KUREBAYASHI, et al.

It is certified that error appears in the above-indentified patent and that said Letters Patent is hereby corrected as shown below:

FRONT, 54 , after "HIGH TENSILE" insert --WELDED-- and after "STEEL" insert --PLATE--.

Column 1, line 60, change "Examined" to --Unexamined--.

Column 5, line 15, change "v" to --V--.

Column 14, line 9, after "steel" insert --plate--.

Column 14, line 26, before "welded" insert --high tensile--.

Colum 14, line 30, before "welded" insert --high tensile--.

Column 14, line 34, before "welded" insert --high tensile--.

Column 14, line 38, before "welded" insert --high tensile--.

UNITED STATES PATENT AND TRADEMARK OFFICE

CERTIFICATE OF CORRECTION

PATENT NO. : 5,634,988

DATED : June 3, 1997

INVENTOR(S) : Katsumi KUREBAYASHI, et al.

It is certified that error appears in the above-indentified patent and that said Letters Patent is hereby corrected as shown below:

Signed and Sealed this

Second Day of June, 1998

*Attest:*

Bruce Lehman

BRUCE LEHMAN

*Attesting Officer*

*Commissioner of Patents and Trademarks*